US006749298B1

(12) United States Patent
Schalk et al.

(10) Patent No.: US 6,749,298 B1
(45) Date of Patent: Jun. 15, 2004

(54) POWER TRANSMISSION ARRANGEMENT

(75) Inventors: Wesley Ryan Schalk, Camas, WA (US); Allan G. Olson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/375,428

(22) Filed: Feb. 27, 2003

(51) Int. Cl.[7] ..... B41J 2/01
(52) U.S. Cl. ..... 347/104
(58) Field of Search ..... 347/104, 101; 400/578; 226/10; 399/361; 346/134; 271/8.1, 4.04, 3.06, 9.08, 10.04, 10.01, 10.09, 10.1, 10.11, 10.13; 192/20, 21; 475/165, 207–219

(56) References Cited

U.S. PATENT DOCUMENTS 4,920,258 A 4/1990 Saito
5,435,537 A 7/1995 Gysling
5,547,181 A 8/1996 Underwood
5,559,538 A 9/1996 Nguyen et al.
5,782,468 A 7/1998 Wu et al.
5,788,383 A 8/1998 Harada et al.
5,831,644 A 11/1998 Kato
5,886,714 A 3/1999 Burney et al.
6,155,680 A 12/2000 Belon et al.
6,172,691 B1 1/2001 Belon et al.
6,257,569 B1 7/2001 Rhodes et al.

*Primary Examiner*—Raquel Y. Gordon

(57) ABSTRACT

A printing system includes a media transport assembly adapted to route media through a media path of the printing system, a motor adapted to drive the media transport assembly, and a power transmission arrangement operatively coupling the motor with the media transport assembly. The media transport assembly includes a pick assembly adapted to draw the media into the media path and a feed assembly adapted to feed the media through the media path. A portion of the power transmission arrangement is adapted to rotate in a first direction to couple the motor with the pick assembly and the feed assembly and rotate in a second direction opposite the first direction to couple the motor with the feed assembly and decouple the motor from the pick assembly.

33 Claims, 5 Drawing Sheets

POWER TRANSMISSION ARRANGEMENT

CROSS-REFERENCE TO RELATED APPLICATIONS

This application is related to U.S. patent application Ser. No. 10/164,119, filed on May 31, 2002, assigned to the assignee of the present invention, and incorporated herein by reference.

BACKGROUND

An inkjet printing system may include a printhead and an ink supply which supplies liquid ink to the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

An inkjet printing system may include a print media transport assembly which moves and/or routes the print medium through a print media path, a carriage assembly which moves the printhead relative to the print medium, and a service station assembly which maintains functionality of the printhead. The print media transport assembly typically includes a paper pick-up assembly which brings the print medium into the printing system, a drive or feed roller assembly which advances the print medium through the printing system, and a paper path motor which operates the paper pick-up assembly and the feed roller assembly. The carriage assembly typically includes a carriage which carries the printhead and a carriage motor which operates the carriage. Furthermore, the service station assembly typically includes a service station motor which operates functions of the service station assembly.

Operation of these types of inkjet printing systems, therefore, involves the operation of three separate motors. More specifically, operation of the inkjet printing system involves the operation of a paper path motor, a carriage motor, and a service station motor. Unfortunately, the use of three motors adds to the size, complexity, and cost of these types of inkjet printing systems.

SUMMARY OF THE INVENTION

A printing system includes a media transport assembly adapted to route media through a media path of the printing system, a motor adapted to drive the media transport assembly, and a power transmission arrangement operatively coupling the motor with the media transport assembly. The media transport assembly includes a pick assembly adapted to draw the media into the media path and a feed assembly adapted to feed the media through the media path. A portion of the power transmission arrangement is adapted to rotate in a first direction to couple the motor with the pick assembly and the feed assembly and rotate in a second direction opposite the first direction to couple the motor with the feed assembly and decouple the motor from the pick assembly.

DESCRIPTION OF THE PREFERRED EMBODIMENTS

In the following detailed description of the preferred embodiments, reference is made to the accompanying drawings which form a part hereof, and in which is shown by way of illustration specific embodiments in which embodiments of the invention may be practiced. In this regard, directional terminology, such as "top," "bottom," "front," "back," "leading," "trailing," etc., is used with reference to the orientation of the Figure(s) being described. Because components of the embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
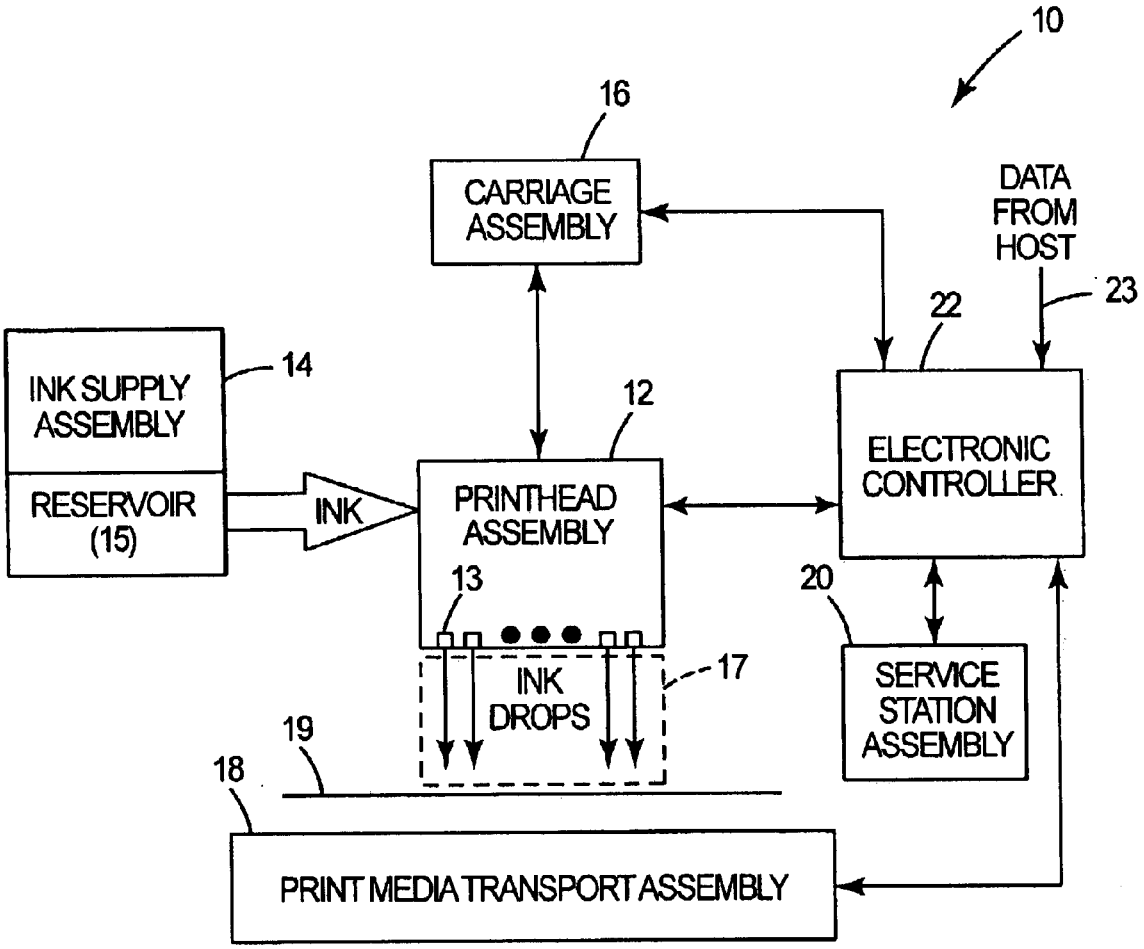
FIG. 1 is a block diagram illustrating one embodiment of an inkjet printing system according to an embodiment of the present invention.

FIG. 1 illustrates one embodiment of an inkjet printing system 10 according to embodiments of the present invention. Inkjet printing system 10 includes an inkjet printhead assembly 12, an ink supply assembly 14, a carriage assembly 16, a print media transport assembly 18, a service station assembly 20, and an electronic controller 22. Inkjet printhead assembly 12 includes one or more printheads which eject drops of ink through a plurality of orifices or nozzles 13 and toward an embodiment of media, such as print medium 19, so as to print onto print medium 19. Print medium 19 is any type of suitable sheet material, such as paper, card stock, transparencies, Mylar, cloth, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Carriage assembly 16 positions inkjet printhead assembly 12 relative to print media transport assembly 18 and print media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, carriage assembly 16 moves inkjet printhead assembly 12 relative to print media transport assembly 18 to scan print medium 19.

Service station assembly 20 provides for spitting, wiping, capping, and/or priming of inkjet printhead assembly 12 in order to maintain a functionality of inkjet printhead assembly 12 and, more specifically, nozzles 13. In one embodiment, service station assembly 20 includes a rubber blade or wiper which is periodically passed over inkjet printhead assembly 12 to wipe and clean nozzles 13 of excess ink. In one embodiment, service station assembly 20 includes a cap which covers inkjet printhead assembly 12 to protect nozzles 13 from drying out during periods of non-use. In one embodiment, service station assembly 20 includes a spittoon into which inkjet printhead assembly 12 ejects ink to insure that reservoir 15 maintains an appropriate level of pressure and fluidity, and insure that nozzles 13 do not clog or weep. Functions of service station assembly 20 include relative motion between service station assembly 20 and inkjet printhead assembly 12.

Electronic controller 22 communicates with inkjet printhead assembly 12, carriage assembly 16, print media transport assembly 18, and service station assembly 20. Electronic controller 22 receives data 23 from a host system, such as a computer, and includes memory for temporarily storing data 23. Typically, data 23 is sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one embodiment, electronic controller 22 provides control of inkjet printhead assembly 12 including timing control for ejection of ink drops from nozzles 13. As such, electronic controller 22 defines a pattern of ejected ink drops which form characters, symbols, and/or other graphics or images on print medium 19. Timing control and, therefore, the pattern of ejected ink drops, is determined by the print job commands and/or command parameters.

Figure 2:
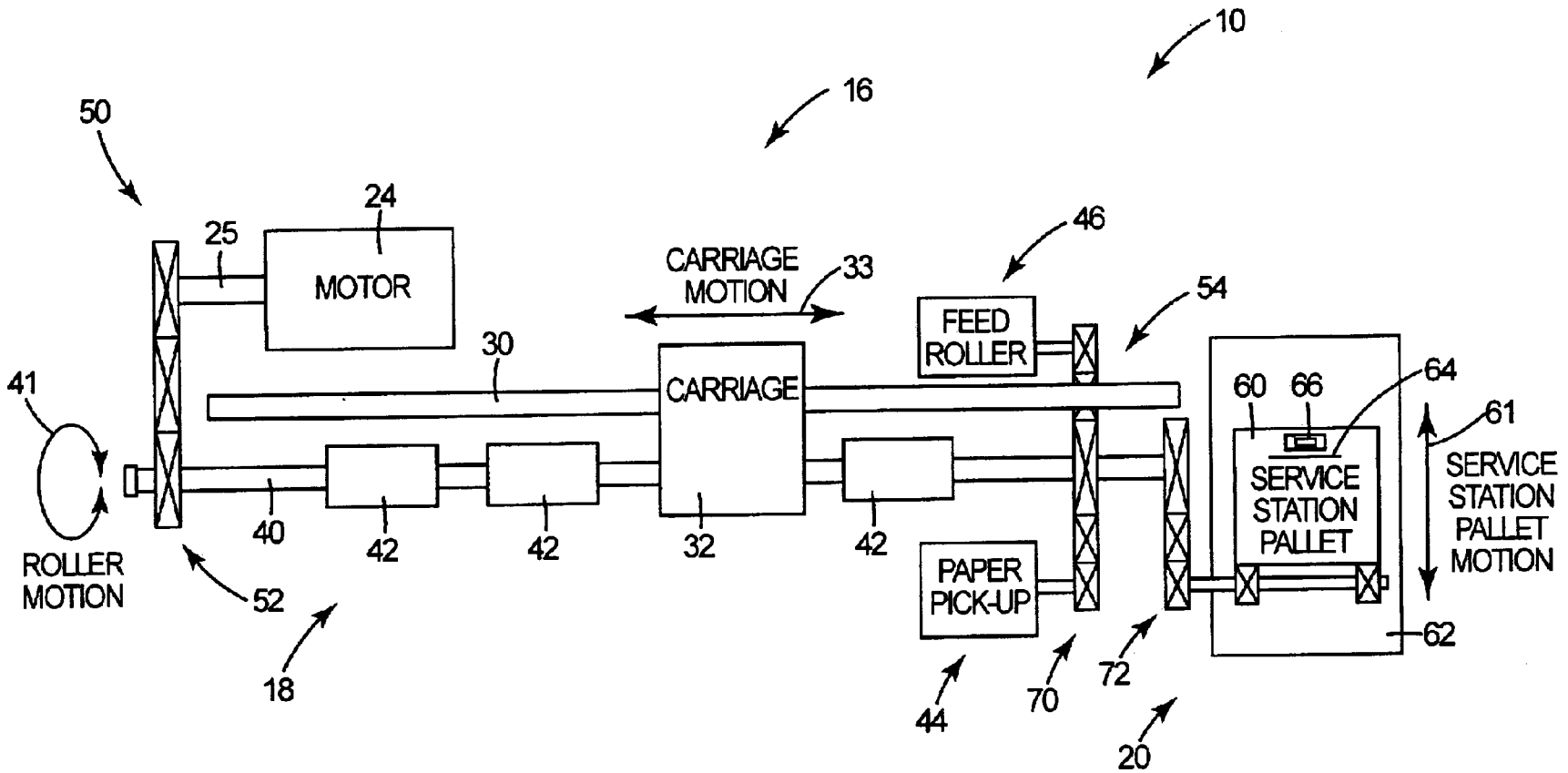
FIG. 2 is a schematic illustration of one embodiment of a portion of an inkjet printing system according to an embodiment of the present invention.

Referring to FIG. 2, inkjet printing system 10 includes a drive motor 24. Motor 24 is operatively coupled with print media transport assembly 18 and service station assembly 20. As such, motor 24 operates, drives, or powers both print media transport assembly 18 and service station assembly 20. Thus, power from motor 24 is selectively transmitted to both print media transport assembly 18 and service station assembly 20, as described below. Motor 24, therefore, includes an output 25 which is selectively coupled with both print media transport assembly 18 and service station assembly 20. It is understood that FIG. 2 is a simplified schematic illustration of one embodiment of a portion of inkjet printing system 10.

In one embodiment, carriage assembly 16 includes a carriage rail 30 and a carriage 32. Carriage rail 30 is mounted in a housing (not shown) of inkjet printing system 10 and provides a guide for carriage 32. Carriage 32 carries inkjet printhead assembly 12 and is slidably mounted on carriage rail 30 for lateral movement, as indicated by bi-directional arrow 33. As such, carriage 32 moves inkjet printhead assembly 12 back and forth across print medium 19.

In one embodiment, print media transport assembly 18 includes a drive shaft 40 and one or more drive rollers 42. Drive shaft 40 is mounted in a housing (not shown) of inkjet printing system 10 for rotational movement, as indicated by bi-directional arrow 41. Drive rollers 42 are mounted on drive shaft 40 to contact and route print medium 19 through a media path of inkjet printing system 10. As such, drive rollers 42 advance print medium 19 relative to carriage 32 in a direction substantially perpendicular to the direction of motion of carriage 32. Drive shaft 40 and drive rollers 42 constitute one embodiment of a drive roller or drive assembly of print media transport assembly 18.

In one embodiment, print media transport assembly 18 also includes a paper pick-up or pick assembly 44 and a feed roller or feed assembly 46. Pick assembly 44 initially engages a top sheet of print medium 19 and draws print medium 19 into a media path of inkjet printing system 10. As such, feed assembly 46 feeds print medium 19 through the media path of inkjet printing system 10 to drive rollers 42. Motion is imparted to pick assembly 44 and feed assembly 46 via drive shaft 40, as described below.

To transfer power of motor 24 to print media transport assembly 18, a power transmission arrangement 50 is interposed between motor 24 and print media transport assembly 18. In one embodiment, power transmission arrangement 50 includes a power transmission arrangement 52 which transfers rotational power of motor 24 to drive shaft 40 of print media transport assembly 18, and a power transmission arrangement 54 which transfers rotational power of motor 24 to pick assembly 44 and/or feed assembly 46. Power transmission arrangement 52, therefore, imparts rotational motion of motor 24 to drive shaft 40 and drive rollers 42, and power transmission arrangement 54 imparts rotational motion of motor 24 to pick assembly 44 and/or feed assembly 46. Power from motor 24 is transferred to pick assembly 44 and/or feed assembly 46 via power transmission arrangement 54, as described below.

In one embodiment, service station assembly 20 includes a service station sled or pallet 60 and a frame or chassis 62. In one embodiment, service station pallet 60 carries, for example, one or more wipers 64 which pass over inkjet printhead assembly 12 to clean and/or remove excess ink from a face of inkjet printhead assembly 12. In one embodiment, service station pallet 60 carries at least one cap 66 which covers inkjet printhead assembly 12 when not in use to prevent inkjet printhead assembly 12 from drying out.

Wiping and capping of inkjet printhead assembly 12 can utilize the motion of service station assembly 20 and, more specifically, motion of service station pallet 60 relative to inkjet printhead assembly 12. As such, service station pallet 60 is mounted in chassis 62 for movement, as indicated by bi-directional arrow 61. Thus, movement of service station pallet 60 is in a direction substantially perpendicular to the direction of movement of carriage 32. Accordingly, service station pallet 60 provides for orthogonal and translational wiping of inkjet printhead assembly 12.

To transfer power of motor 24 to service station assembly 20, a power transmission arrangement 70 is interposed between motor 24 and service station assembly 20. In one embodiment, power transmission arrangement 70 includes a gear train 72 which transfers rotational power of motor 24 to service station pallet 60. One embodiment of a power transmission arrangement for transferring rotational power of motor 24 to service station assembly 20 is described, for example, in U.S. patent application Ser. No. 10/164,119, assigned to the assignee of the present invention.

Figure 3A:
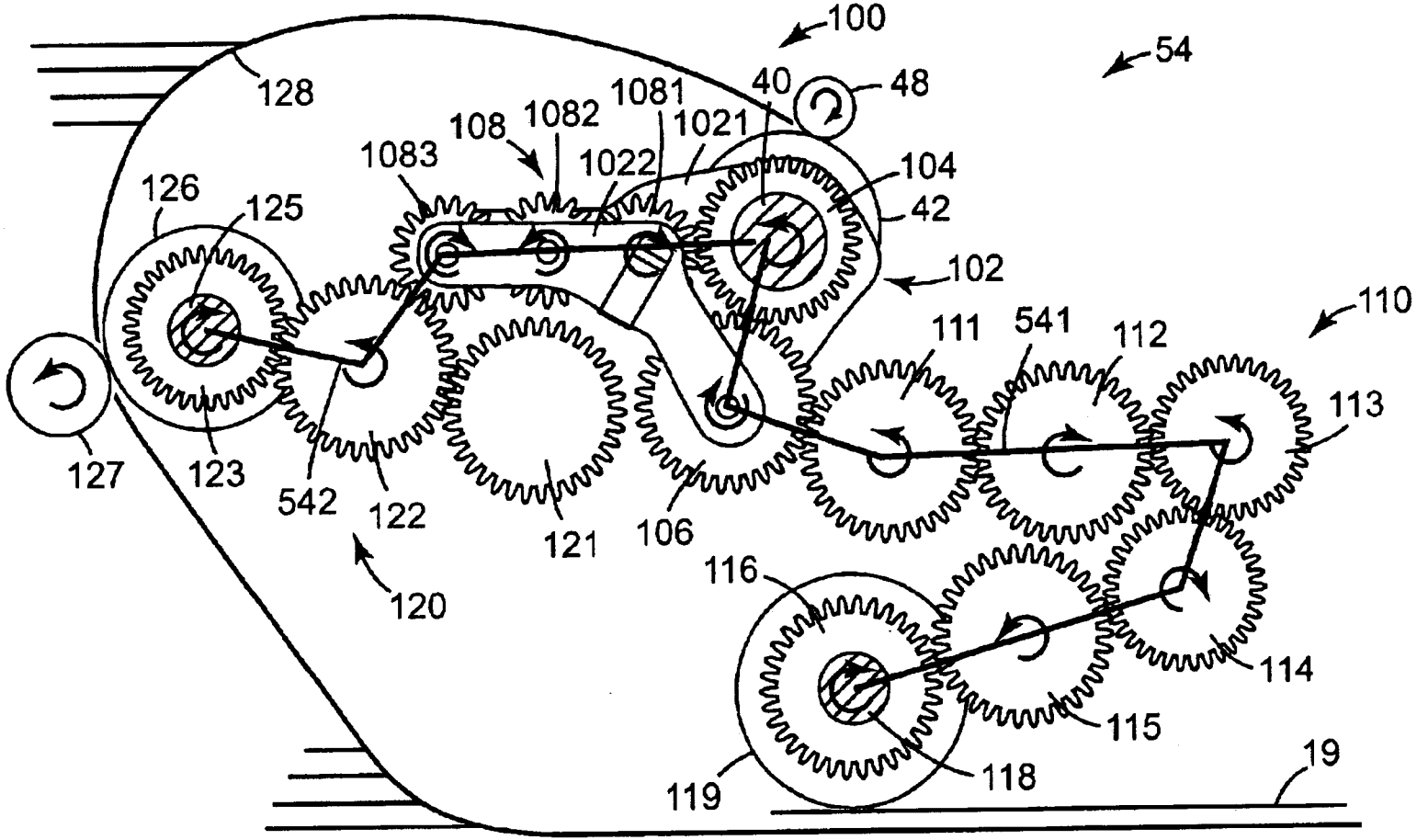
FIG. 3A is a sectional side view illustrating one embodiment of a portion of a media transport power transmission arrangement in a first mode.
Figure 3B:
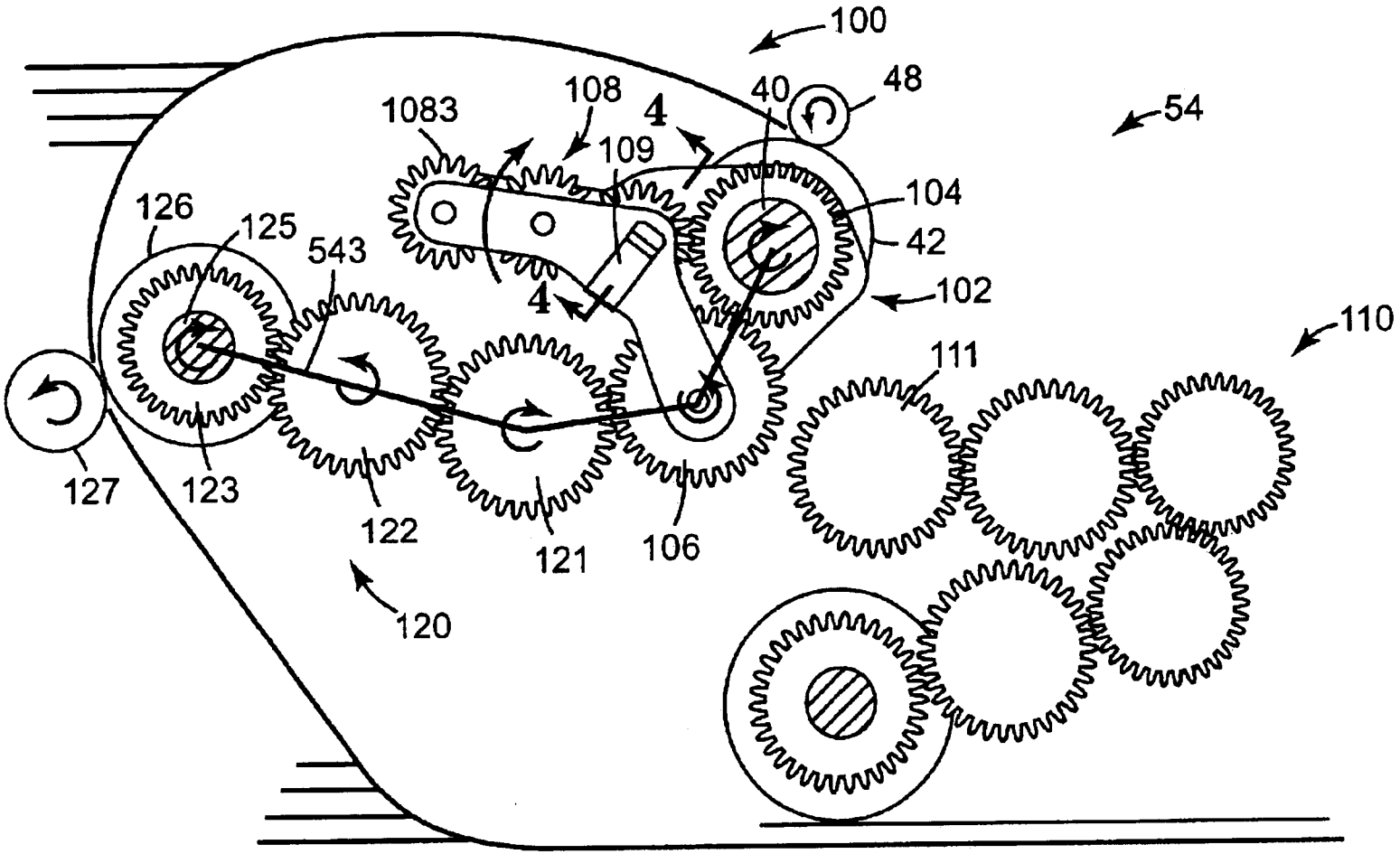
FIG. 3B is a sectional side view of the media transport power transmission arrangement of FIG. 3A in a second mode.

FIGS. 3A and 3B illustrate one embodiment of power transmission arrangement 54. More specifically, FIG. 3A illustrates one embodiment of power transmission arrangement 54 in a first mode of operation with power from motor 24 being coupled with pick assembly 44 and feed assembly 46, and FIG. 3B illustrates one embodiment of power transmission arrangement 54 in a second mode of operation with power from motor 24 being coupled with feed assembly 46. In one embodiment, power transmission arrangement 54 includes a power transfer drive train 100, a pick assembly drive train 110, and a feed assembly drive train 120. Power transfer drive train 100 selectively couples motor 24 with pick assembly drive train 110 and feed assembly drive train 120 to transfer power from motor 24 to pick assembly 44 and feed assembly 46, respectively, as described below.

In one embodiment, pick assembly drive train 110 includes an input gear a plurality of idler gears 112, 113, 114, and 115, and an output gear 116. Idler gears 112, 113, 114, and 115 are engaged with each other and with input gear 111, and output gear 116 is engaged with idler gears 112, 113, 114, and 115, such that rotational motion of input gear 111 is imparted to output gear 116. Output gear 116 is mounted on a pick shaft 118 of pick assembly 44 and operates a pick roller 119 (also mounted on pick shaft 118) of pick assembly 44 to engage and draw print medium 19 into a media path of inkjet printing system 10.

In one embodiment, feed assembly drive train 120 includes an input gear 121, an idler gear 122, and an output gear 123. Idler gear 122 is engaged with input gear 121, and output gear 123 is engaged with idler gear 122 such that rotational motion of input gear 121 is imparted to output gear 123 via idler gear 122. Output gear 123 is mounted on a feed shaft 125 of feed assembly 46 and operates a feed roller 126 (also mounted on feed shaft 125) of feed assembly 46 to feed print medium 19 through the media path of inkjet printing system 10. In one embodiment, feed assembly 46 includes a pinch roller 127 mounted opposite of feed roller 126 to form a nip for engaging print medium 19.

In one embodiment, power transfer drive train 100 includes a swing arm 102, a drive gear 104, a transfer gear 106, and an idler gear train 108. Swing arm 102 is supported for rotation between a first position, as illustrated in the embodiment of FIG. 3A, and a second position, as illustrated in the embodiment of FIG. 3B. In one embodiment, drive shaft 40 extends through and supports swing arm 102. As such, swing arm 102 is supported by and rotatable relative to drive shaft 40. Thus, swing arm 102 is rotatable between the first position and the second position about an axis of drive shaft 40.

Swing arm 102 supports transfer gear 106 and idler gear train 108 such that transfer gear 106 and idler gear train 108 move with swing arm 102. In one embodiment, swing arm 102 includes a first plate 1021 and a second plate 1022. As such, transfer gear 106 and idler gear train 108 are supported between first plate 1021 and second plate 1022. Rotation of swing arm 102 between the first position and the second position moves transfer gear 106 between an engaged position with pick assembly drive train 110 and an engaged position with feed assembly drive train 120, as described below. In addition, rotation of swing arm 102 between the first position and the second position moves idler gear train 108 between an engaged position and a disengaged position with feed assembly drive train 120, also as described below.

Drive gear 104 is mounted on drive shaft 40 for rotation with drive shaft 40. As such, drive gear 104 is rotatable relative to swing arm 102. Transfer gear 106 is engaged with drive gear 104 such that rotational motion of drive gear 104 is imparted to transfer gear 106.

In one embodiment, transfer gear 106 is freely supported by swing arm 102 and movable between an engaged position with pick assembly drive train 110, as illustrated in the embodiment of FIG. 3A, and an engaged position with feed assembly drive train 120, as illustrated in the embodiment of FIG. 3B. In the engaged position with pick assembly drive train 110, transfer gear 106 is engaged with input gear 111 of pick assembly drive train 110 such that rotational motion of drive gear 104 is imparted to pick assembly drive train 110 via transfer gear 106. In the engaged position with feed assembly drive train 120, transfer gear 106 is engaged with input gear 121 of feed assembly drive train 120 such that rotational motion of drive gear 104 is imparted to feed assembly drive train 120 via transfer gear 106.

In one embodiment, idler gear train 108 includes a first idler gear 1081, a second idler gear 1082, and a third idler gear 1083. First idler gear 1081 is engaged with drive gear 104, second idler gear 1082 is engaged with first idler gear 1081, and third idler gear 1083 is engaged with second idler gear 1082. As such, rotational motion of drive gear 104 is imparted to third idler gear 1083 via first idler gear 1081 and second idler gear 1082.

Idler gear train 108 is supported by swing arm 102 and movable between an engaged position, as illustrated in the embodiment of FIG. 3A, and a disengaged position, as illustrated in the embodiment of FIG. 3B. In the engaged position, third idler gear 1083 is engaged with idler gear 122 of feed assembly drive train 120 such that rotational motion of drive gear 104 is imparted to feed assembly drive train 120 via idler gear train 108. However, in the disengaged position, third idler gear 1083 is disengaged from idler gear 122 of feed assembly drive train 120 such that rotational motion of drive gear 104 is not imparted to feed assembly drive train 120 via idler gear train 108.

In one embodiment, second idler gear 1082 and third idler gear 1083 are freely supported by swing arm 102. First idler gear 1081, however, is subjected to a drag force. The drag force is imposed on first idler gear 1081 such that rotation of drive gear 104 in a given direction causes rotation of swing arm 102 in the same direction. More specifically, with the drag force imposed on first idler gear 1081, first idler gear 1081 initially opposes rotation imparted by drive gear 104. As such, with first idler gear 1081 being supported by swing arm 102 and swing arm 102 being rotatably supported about drive shaft 40, initial rotation of drive gear 104 in a given direction causes rotation of swing arm 102 in the same direction about an axis of drive shaft 40.

As described above, rotation of swing arm 102 moves transfer gear 106 between an engaged position with pick assembly drive train 110 and an engaged position with feed assembly drive train 120. However, once transfer gear 106 engages pick assembly drive train 110 or feed assembly drive train 120 and the drag force imposed on first idler gear 1081 is overcome, further rotation of drive gear 104 causes rotation of first idler gear 1081. As such, when swing arm 102 is in the first position (FIG. 3A), rotation of first idler gear 1081 causes rotation of second idler gear 1082 and third idler gear 1083 which, in turn, imparts rotational motion to feed assembly drive train 120.

Figure 4:
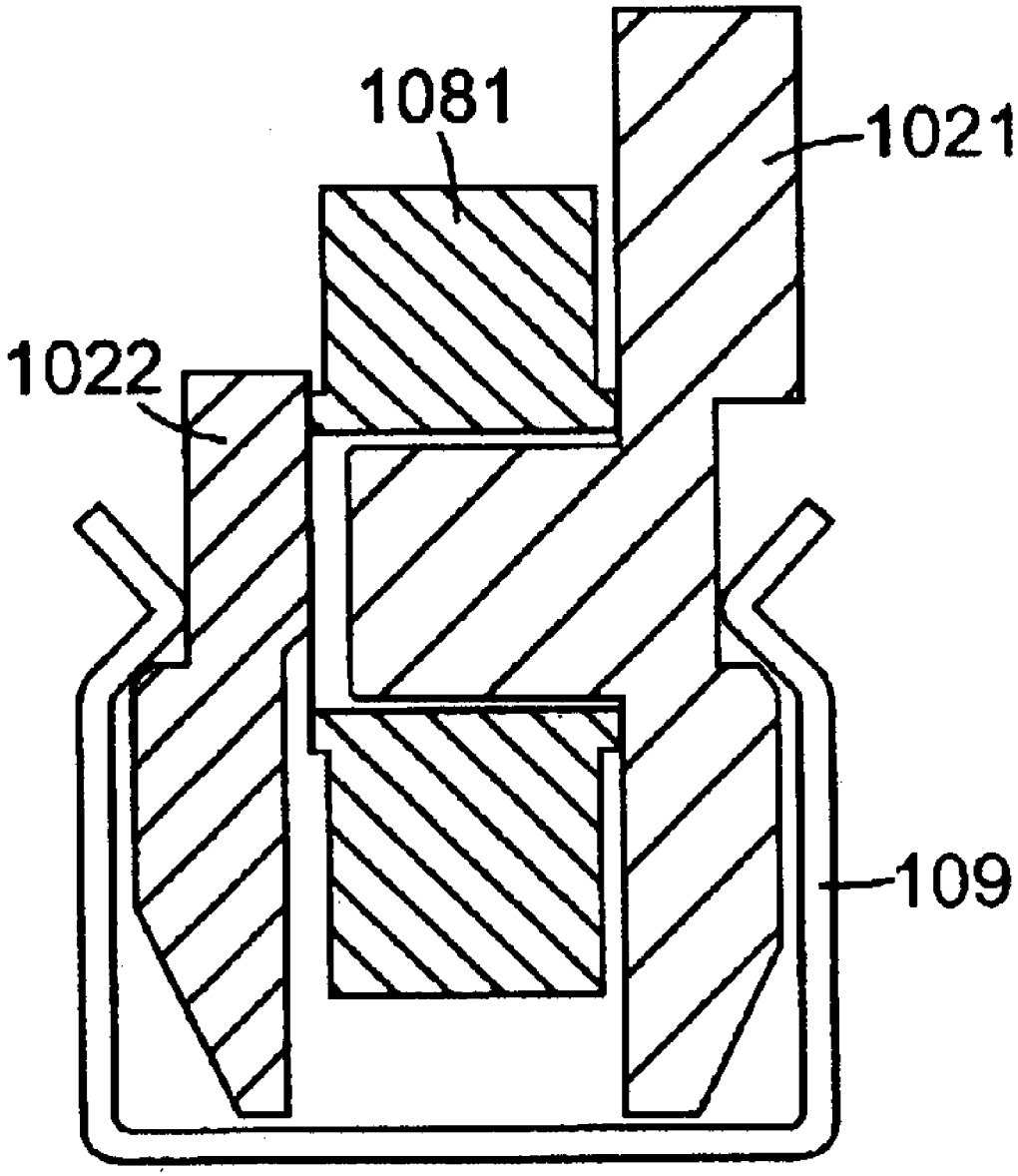
FIG. 4 is a cross-sectional view taken along line 4—4 of FIG. 3B.

In one embodiment, as illustrated in FIG. 4, power transfer drive train 100 includes a clip 109 which imposes the drag force on first idler gear 1081. In one embodiment, as described above, first idler gear 1081 is supported between plates 1021 and 1022 of swing arm 102. As such, clip 109 is positioned laterally of plates 1021 and 1022 so as to bias plates 1021 and 1022 against idler gear 1081 and impose the drag force on first idler gear 1081.

In one embodiment, rotation of drive shaft 40 actuates power 15 transmission arrangement 54 to selectively couple motor 24 with pick assembly 44 and/or feed assembly 46. More specifically, rotation of drive shaft 40 in a first direction couples motor 24 with pick assembly 44 and feed assembly 46, and rotation of drive shaft 40 in a second direction opposite the first direction couples motor 24 with feed assembly 46.

As illustrated in the embodiment of FIG. 3A, rotation of drive shaft 40 and, therefore, drive gear 104 in a counter-clockwise (CCW) direction causes swing arm 102 to rotate in a CCW direction to the first position due to the drag force imposed on first idler gear 1081. As swing arm 102 rotates to the first position, transfer gear 106 engages input gear 111 of pick assembly drive train 110 and third idler gear 1081 of idler gear train 108 engages idler gear 122 of feed assembly drive train 120. As such, rotation of drive shaft 40 in the CCW direction transmits rotational motion to pick shaft 118 of pick assembly 44, as indicated by power transmission path 541, and feed shaft 125 of feed assembly 46, as indicated by power transmission path 542. Thus, with rotational motion transmitted to pick shaft 118 and feed shaft 125, pick assembly 44 can engage and draw a sheet of print medium 19 into a media path of inkjet printing system 10 and feed assembly 46 can feed print medium 19 through the media path.

As illustrated in the embodiment of FIG. 3A, CCW rotation of drive shaft 40 results in clockwise (CW) rotation of pick shaft 118 and CW rotation of feed shaft 125. As such, pick roller 119 and feed roller 126 both rotate in a CW direction while drive roller 42 (mounted on drive shaft 40) rotates in a CCW direction. The CW rotation of pick roller 119 draws a sheet of print medium 19 into the media path of inkjet printing system 10 and, in association with a media guide 128, directs print medium 19 to an advancing nip between feed roller 126 and pinch roller 127.

In one embodiment, the CW rotation of feed roller 126, in association with pinch roller 127 and media guide 128, feeds print medium 19 to a nip between drive roller 42 and a pinch roller 48 mounted opposite of drive roller 42. The CCW rotation of drive roller 42, however, produces a reversing nip between drive roller 42 and pinch roller 48 which prevents print medium 19 from passing between drive roller 42 and pinch roller 48. Feeding print medium 19 into the reversing nip between drive roller 42 and pinch roller 48 can serve to align or de-skew print medium 19.

In another embodiment, feed roller 126 and pinch roller 127 hold print medium 19 in the media path of inkjet printing system 10 such that pick assembly 44 can be released and the rotation of drive shaft 40 can be reversed before print medium 19 is fed to drive roller 42 and pinch roller 48. As described below, CW rotation of drive shaft 40 results in CW rotation of drive roller 42 and CW rotation of feed roller 126 such that feed roller 126, in association with media guide 128, feeds print medium 19 to an advancing nip between drive roller 42 and pinch roller 48. As such, drive roller 42 advances print medium 19 through the media path of inkjet printing system 10. Thus, with power transmission arrangement 54, inkjet printing system 10 can be operated to de-skew or not de-skew print medium 19. Choosing not to de-skew print medium 19 can result in faster throughput of print medium 19.

As illustrated in the embodiment of FIG. 3B, rotation of drive shaft 40 and, therefore, drive gear 104 in a CW direction causes swing arm 102 to rotate in a CW direction to the second position due to the drag force imposed on first idler gear 1081. As swing arm 102 rotates to the second position, transfer gear 106 disengages from input gear 11 of pick assembly drive train 110 and engages input gear 121 of feed assembly drive train 120. In addition, third idler gear 1083 of idler gear train 108 disengages from idler gear 122 of feed assembly drive train 120. As such, rotation of drive shaft 40 in the CW direction transmits rotational motion to feed shaft 125 of feed assembly 120, as indicated by power transmission path 543. Thus, with rotational motion transmitted to feed shaft 125, feed assembly 46 can feed print medium 19 through the media path of inkjet printing system 10. With transfer gear 106 disengaged from pick assembly drive train 110, pick assembly 44 is in a neutral or free-wheeling state.

As illustrated in the embodiment of FIG. 3B, CW rotation of drive shaft 40 results in CW rotation of feed shaft 125. As such, feed roller 126 and drive roller 42 both rotate in a CW direction. The CW rotation of feed roller 126 feeds print medium 19 through the media path to drive roller 42 and the CW rotation of drive roller 42 advances print medium 19 through print zone 17 (FIG. 1) of inkjet printing system 10.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printing system, comprising:

a media transport assembly adapted to route media through a media path of the printing system;

a motor adapted to drive the media transport assembly; and a power transmission arrangement operatively coupling the motor with the media transport assembly, wherein the media transport assembly includes a pick assembly adapted to draw the media into the media path and a feed assembly adapted to feed the media through the media path, and wherein a portion of the power transmission arrangement is adapted to rotate in a first direction to couple the motor with the pick assembly and the feed assembly and rotate in a second direction opposite the first direction to couple the motor with the feed assembly and decouple the motor from the pick assembly.

2. The printing system of claim 1, further comprising:

a carriage assembly adapted to hold a printhead and traverse the media, wherein the power transmission arrangement is adapted to selectively couple the motor with the pick assembly and the feed assembly when the carriage assembly is in a position to traverse the media.

3. The printing system of claim 1, wherein the media transport assembly further includes a drive assembly adapted to advance the media through the media path, and wherein the motor is coupled with the drive assembly.

4. The printing system of claim 3, wherein the motor is adapted to drive the drive assembly in a first drive direction and, via the power transmission arrangement, drive the pick assembly and the feed assembly in a second drive direction opposite the first drive direction.

5. The printing system of claim 3, wherein the motor is adapted to drive the drive assembly in a first drive direction and, via the power transmission arrangement, drive the feed assembly in the first drive direction.

6. The printing system of claim 1, wherein the power transmission arrangement includes:

a drive shaft;

a drive gear mounted on the drive shaft;

a swing arm supported by the drive shaft and rotatable between a first position and a second position; and a transfer gear supported by the swing arm, engaged with the drive gear, and movable between an engaged position with the pick assembly and an engaged position with the feed assembly when the swing arm is rotated between the first position and the second position.

7. The printing system of claim 6, wherein rotation of the drive shaft in the first direction is adapted to rotate the swing arm to the first position and rotation of the drive shaft in the second direction opposite the first direction is adapted to rotate the swing arm to the second position.

8. The printing system of claim 6, wherein the power transmission arrangement further includes:

a first idler gear supported by the swing arm and engaged with the drive gear;

a second idler gear supported by the swing arm and engaged with the first idler gear; and a third idler gear supported by the swing arm and engaged with the second idler gear, wherein the third idler gear is adapted to engage the feed assembly when the swing arm is in the first position.

9. The printing system of claim 8, wherein a drag force on the first idler gear is adapted to rotate the swing arm to the first position with rotation of the drive gear in the first direction and rotate the swing arm to the second position with rotation of the drive gear in the second direction opposite the first direction.

10. The printing system of claim 6, wherein the swing arm is adapted to rotate about an axis of the drive shaft.

11. A method of operating a printing system, the method comprising:

routing media through a media path of the printing system via a media transport assembly, including drawing the media into the media path with a pick assembly and feeding the media through the media path with a feed assembly; and driving the media transport assembly with a motor, including rotating a portion of a power transmission arrangement interposed between the motor and the media transport assembly in a first direction to couple the motor with the pick assembly and the feed assembly, and rotating the portion of the power transmission arrangement in a second direction opposite the first direction to couple the motor with the feed assembly and decouple the motor from the pick assembly.

12. The method of claim 11, further comprising:

traversing the media with a carriage assembly, wherein driving the media transport assembly includes selectively coupling the motor with the pick assembly and the feed assembly via the power transmission arrangement when the carriage assembly is in a position to traverse the media.

13. The method of claim 11, wherein routing the media further includes advancing the media through the media path with a drive assembly, and wherein driving the media transport assembly includes coupling the motor with the drive assembly.

14. The method of claim 13, wherein driving the media transport assembly includes driving the drive assembly in a first drive direction and, via the power transmission arrangement, driving the pick assembly and the feed assembly in a second drive direction opposite the first drive direction.

15. The method of claim 13, wherein driving the media transport assembly includes driving the drive assembly in a first drive direction and, via the power transmission arrangement, driving the feed assembly in the first drive direction.

16. The method of claim 11, wherein the power transmission arrangement includes:

a drive shaft;

a drive gear mounted on the drive shaft;

a swing arm supported by the drive shaft; and a transfer gear supported by the swing arm and engaged with the drive gear, wherein driving the media transport assembly includes rotating the swing arm between a first position and a second position and engaging the pick assembly with the transfer gear when the swing arm is in the first position and engaging the feed assembly with the transfer gear when the swing arm is in the second position.

17. The method of claim 16, wherein driving the media transport assembly includes rotating the drive shaft in the first direction to rotate the swing arm to the first position and rotating the drive shaft in the second direction opposite the first direction to rotate the swing arm to the second position.

18. The method of claim 16, wherein the power transmission arrangement further includes:

a first idler gear supported by the swing arm and engaged with the drive gear;

a second idler gear supported by the swing arm and engaged with the first idler gear;

and a third idler gear supported by the swing arm and engaged with the second idler gear, wherein driving the media transport assembly further includes engaging the feed assembly with the third idler gear when the swing arm is in the first position.

19. The method of claim 18, wherein rotating the swing arm includes imposing a drag force on the first idler gear and rotating the swing arm to the first position with rotation of the drive gear in the first direction and rotating the swing arm to the second position with rotation of the drive gear in the second direction opposite the first direction.

20. The method of claim 16, wherein rotating the swing arm includes rotating the swing arm about an axis of the drive shaft.

21. A power transmission arrangement, comprising:

a shaft;

a first gear mounted on the shaft;

an arm supported by the shaft and rotatable between a first position and a second position;

a second gear supported by the arm, engaged with the first gear, and movable between an engaged position with a first drive train and an engaged position with a second drive train when the arm is rotated between the first position and the second position; and a gear train supported by the arm, engaged with the first gear, and movable between an engaged position and a disengaged position with the second drive train when the arm is rotated between the first position and the second position.

22. The power transmission arrangement of claim 21, wherein rotation of the shaft in a first direction is adapted to rotate the arm to the first position and rotation of the shaft in a second direction opposite the first direction is adapted to rotate the arm to the second position.

23. The power transmission arrangement of claim 21, wherein the arm is adapted to rotate about an axis of the shaft.

24. The power transmission arrangement of claim 21, wherein the gear train includes:

a third gear supported by the arm and engaged with the first gear;

a fourth gear supported by the arm and engaged with the third gear; and a fifth gear supported by the arm and engaged with the fourth gear, wherein the fifth gear is movable between the engaged position and the disengaged position with the second drive train when the arm is rotated between the first position and the second position.

25. The power transmission arrangement of claim 24, further comprising:

an element adapted to impose a drag force on the third gear, wherein the drag force is adapted to rotate the arm to the first position with rotation of the first gear in a first direction and rotate the arm to the second position with rotation of the first gear in a second direction opposite the first direction.

26. A power transmission arrangement for selectively transmitting power from a drive shaft to a first drive train and a second drive train, the power transmission arrangement comprising:

a drive gear driven by the drive shaft;

a transfer gear engaging the drive gear; and a swing arm supported by the drive shaft and supporting the transfer gear, wherein rotating the drive shaft in a first direction rotates the swing arm to a first position and engages the transfer gear with the first drive train and rotating the drive shaft in a second direction opposite the first direction rotates the swing arm to a second position and engages the transfer gear with the second drive train.

27. The power transmission arrangement of claim 26, wherein the swing arm rotates about an axis of the drive shaft.

28. The power transmission arrangement of claim 26, further comprising:

first idler gear engaging the drive gear;

a second idler gear engaging the first idler gear; and a third idler gear engaging the second idler gear, wherein the swing arm supports the first idler gear, the second idler gear, and the third idler gear, and wherein the third idler gear engages the second drive train when the swing arm rotates to the first position.

29. The power transmission arrangement of claim 28, further comprising:

an element imposing a drag force on the first idler gear, wherein the drag force opposes rotation of the first idler gear and rotates the swing arm to the first position when rotating the drive gear in the first direction and rotates the swing arm to the second position when rotating the drive gear in the second direction opposite the first direction.

30. A power transmission arrangement, comprising:

a drive shaft;

a drive gear mounted on the drive shaft;

a transfer gear engaged with the drive gear; and means for selectively engaging the transfer gear with a first drive train when the drive shaft is rotated in a first direction and engaging the transfer gear with a second drive train when the drive shaft is rotated in a second direction opposite the first direction.

31. The power transmission arrangement of claim 30, further comprising:

an idler gear train engaged with the drive gear; and means for selectively engaging and disengaging the idler gear train with the second drive train when the drive shaft is rotated in the first direction and the second direction.

32. The power transmission arrangement of claim 31, wherein means for selectively engaging and disengaging the idler gear train with the second drive train includes means for moving the idler gear train between an engaged position and a disengaged position with the second drive train.

33. The power transmission arrangement of claim 30, wherein means for selectively engaging the transfer gear with the first drive train and the second drive train includes means for moving the transfer gear between an engaged position with the first drive train and an engaged position with the second drive train.

* * * * *